United States Patent [19]

Larsen

[11] Patent Number: 4,850,206

[45] Date of Patent: Jul. 25, 1989

[54] CRISPER HUMIDITY CONTROL

[75] Inventor: Wallace L. Larsen, Marion, Iowa

[73] Assignee: Amana Refrigeration, Inc., Amana, Iowa

[21] Appl. No.: 272,975

[22] Filed: Nov. 18, 1988

[51] Int. Cl.[4] ..... F25D 25/02

[52] U.S. Cl. ..... 62/382; 62/408

[58] Field of Search ..... 62/382, 408

[56] References Cited

U.S. PATENT DOCUMENTS

| | | | |
|---|---|---|---|
| 4,013,434 | 3/1977 | Kronenberger et al. | 62/382 |
| 4,250,719 | 2/1981 | Grimm et al. | 62/382 |
| 4,488,412 | 12/1984 | Weaver et al. | 62/382 |
| 4,557,118 | 12/1985 | Pink et al. | 62/382 |
| 4,732,014 | 3/1988 | Frohbieter | 62/382 |

*Primary Examiner*—Lloyd L. King

*Attorney, Agent, or Firm*—William R. Clark; Richard M. Sharkansky

[57] ABSTRACT

A crisper humidity control including a shelf having an aperture in the front and a space between the crisper pan and the shelf at the rear to provide flow-through ventilation when both are open. The shelf further includes a laterally slidable shutter for sealing off the front passageway and a damper flap for sealing off the back passageway. A damper actuator arm is linked between the damper flap and the front shutter so that both are operated in unison from a single laterally slidable operator actuable control knob.

11 Claims, 5 Drawing Sheets

CRISPER HUMIDITY CONTROL

BACKGROUND OF THE INVENTION

The field of the invention generally relates to household refrigerators, and more particularly relates to humidity control mechanisms for crisper pans.

Most household refrigerators have one or more pans for storing fresh vegetables and fruits. These pans are typically referred to as crisper pans and their function is to create a storage environment that has a higher humidity than the rest of the refrigerated food compartment. Accordingly, in crisper pans, vegetables and particularly leafy vegetables do not dry out so fast as they would if stored uncovered in the relatively low humidity of the refrigerated food compartment.

A prior art crisper pan typically has side support lips that slidably engage guide channels on the underside of a shelf which also provides a lid for the crisper pan. When the crisper pan is slid to the closed position, the pan is completely sealed underneath the shelf. As a result, the cold, dry air circulating in the refrigerated food compartment is prevented from flowing through the pan; accordingly, the interior of the pan is maintained at a relatively high humidity. Stated differently, by providing a tight seal for the pan, moisture in the vegatables is prevented from escaping the pan to the rest of the refrigerated food compartment. Some prior art crisper pans have also used gaskets to improve the seal.

The prior art shows a recognition that too much moisture in a crisper pan may adversely affect vegetables and fruit. For example, if a large quantity of very moist vegetables is placed in a crisper pan, the very high humidity in the pan may cause condensation which drips down and forms puddles. It is well known that a soggy condition can cause vegetables to wilt or rot. Accordingly, it is known that it may be desirable to adjust or control the humidity in a crisper pan to a preferable range depending on the food load wherein the humidity is high enough to prevent the food from drying out, but is low enough to prevent excessive condensation.

One prior art approach to crisper pan humidity control is described in U.S. Pat. No. 4,013,434 to Kronenberger et al. The cover of the crisper pan has a plurality of side vents running longitudinally from front-to-back. A manual control includes a damper and integral hinge pin with cooperating arcuate fingers extending through the vents, which fingers have surfaces for engaging edge portions of their associated vents to impart positioned stability in any one of a plurality of angularly related positions. The damper has a front tab for manually rotating the damper to any of the plurality of angular positions between fully closed and fully open. A disadvantage of this approach is that it doesn't have cooperating openings on opposing edges of the cover to take advantage of flow-through ventilation. Also, the location of the vents on the sides doesn't take advantage of the natural flow path of recirculating air. More specifically, the cold air flow path of most refrigerators is down the back wall, across the bottom, and then up the front wall. A side vent, on the other hand, does not directly face this flow path. As a rsult, relatively poor control of humidity is provided.

In another approach described in U.S. Pat. No. 4,250,719 to Grimm et al, a crisper pan has a top opening and a stationary cover inside the refrigerator for receiving the pan. Within the stationary cover is a lid having inclined ribs on the underside. Lateral movement of a slide control at the front of the crisper is transformed into forward or backward movement of the lid. In the backward position, the lid rides up onto the ribs thereby elevating it from the crisper pan. Accordingly, openings are provided around the top of the crisper pan and the size of these opening can be varied by the position of the crisper pan relative to the lid. This apparatus, however, has disadvantages. First, the lid does not also function as a shelf because the operative principle requires the lid be vertically movable to adjust the humidity; accordingly, the lid is an extra part that is mounted under the bottom shelf. Not only does this involve extra cost and more complicated fabrication, but it also reduces available refrigerator storage space. Further, the parts and fabrication for an apparatus that transforms movement in one direction to orthogonal motion is generally more complicated and expensive than one that does not. Further, the apparatus is subject to sticking and breaking. Also, because the recirculating air may also leak out the sides, there may be nonuniform humidity in the crisper pan from front-to-back.

Another prior art approach is described in U.S. Pat. No. 4,557,118 to Pink. A back passageway into the crisper pan is alway open, and a front passageway is controlled by a laterally slidable shutter member. Although this arrangement provides many advantages, it is difficult to maintain high humidity with certain food loads because the back passageway always remains open.

SUMMARY OF THE INVENTION

It is an object of the invention to provide an improved humidity control for a refrigerator crisper pan.

It is also an object to provide a humidity control that cooperatively opens and closes both a front and a back passageway while leaving the sides sealed so as to take advantage of the natural cold air circulation path and still maintain uniform humidity from front-to-back within the crisper pan.

It is also an object to provide a humidity control that has a laterally slidable control knob that activates both a front shutter and a rear damper flap.

It is a further object to provide a humidity control that is relatively easy to fabricate, and resists binding or sticking during operation.

In accordance with the invention, a relatively high humidity storage region is provided in a refrigerator compartment by a container comprising a drawer having a bottom side walls, a back wall, and a front wall, the top of each of the side walls having a flanged lip, a cover adapted for stationary horizontal mounting in the refrigerator compartment, the cover having underside parallel slide channels for receiving the lips of the drawer wherein the drawer is slidably engageable in the slide channels to a closed position underneath the cover, the back wall of the drawer being spaced from the cover in the closed position thereby providing a back passageway into the drawer, a damper flap laterally positioned and pivotally mounted to the underside of the cover for opening and closing the back passageway, the cover having a front port and a manually actuable laterally slidable shutter for opening and closing the front port, and a damper actuator arm linked between the shutter and the damper flap, the actuator arm rotating the damper flap in response to manual activation of the front shutter to open and close the back passageway in unison with the opening and closing of the front port. It is preferable that the damper activator arm comprise a rearwardly extending finger and the damper flap comprise a ramp that rides up on the finger. It is also preferable that the damper actuator arm comprise means for maintaining the damper actuator arm in a front-to-back orientation. Also, it is preferable that the cover have a lateral underside rib and the maintaining means comprise an unwardly facing channel engaging the rib. It is also preferable that the shutter comprise a vertical post and that the damper actuator arm have a forward facing notch which engages the post.

With such arrangement, the back and front passageways are opened together and closed together such that when both are open, natural convection air flows down the back of the refrigerator compartment and through the container before flowing up the front of the door. However, when both the front and back passageways are sealed or closed, little moisture escapes from the container, and therefore the interior chamber can be maintained at a relatively high humidity.

BRIEF DESCRIPTION OF THE DRAWINGS

The foregoing objects and advantages will be more fully understood by reading the Description of the Preferred Embodiment with reference to the drawings wherein.

DESCRIPTION OF THE PREFERRED EMBODIMENT

Figure 1:
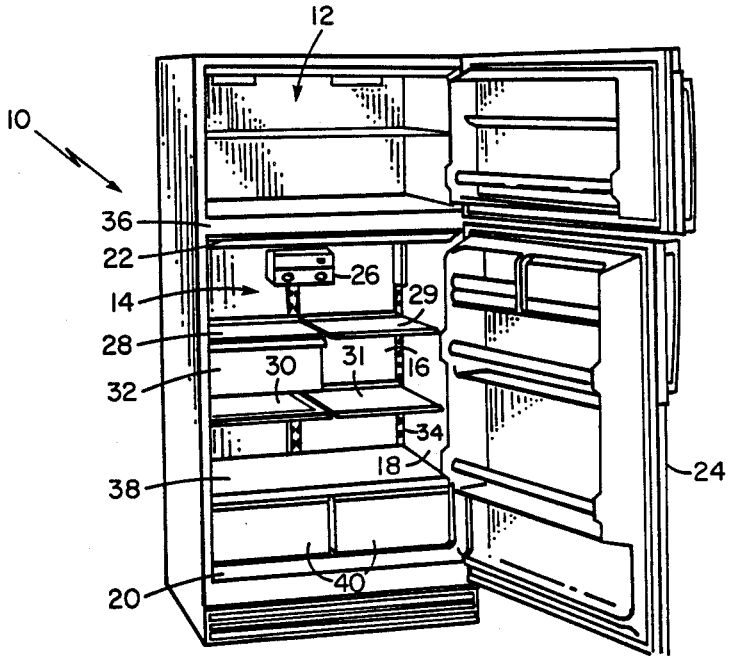
FIG. 1 is a front perspective view of a refrigerator having a pair of crisper pans.

Referring generally to the drawings wherein like reference numerals depict like or similar parts throughout the several views, a container 11 (FIG. 9) is provided in refrigerator compartment 14 to provide a relatively high humidity storage region. The container 11 comprises a drawer or pan 40 having a bottom 98, side walls 92, a back wall 94, and a front wall 96 wherein the side walls 92 have flanged lips 102. A cover or shelf 38 is stationarily mounted in horizontal alignment within the refrigerator compartment 14, and the cover 38 has underside parallel slide channels 104 that receive the flanged lips 102 wherein the drawer 40 is slidably engageable in the slide channels 104 to a closed position underneath the cover 38 wherein the back wall 94 of the drawer 40 is spaced from the cover 38 thereby providing a back passageway or space 138 into the drawer 40. A damper flap 124 is laterally positioned and pivotally mounted to the underside of the cover 38 for opening and closing the back passageway 138. The cover 38 has a front port 56 and a manually actuable laterally slidable shutter 58 or slide gate that opens and closes the front port 56. A damper actuator arm 108 is linked between the shutter 58 and the damper flap 124 wherein the actuator arm rotates the damper flap 124 in response to manual activation of the front shutter 58 to open and close the back passageway 138 in unison with the opening and closing of the front port 56. The damper activator arm 108 includes a rearwardly extending finger 126 and the damper flap 124 includes a ramp 130 that rides up on the finger thereby lifting and lowering the damper flap 124 to open and close the back passageway 138. The actuator arm 108 is maintained in front-to-back orientation by an upwardly facing channel 122 that engages a rib 118 on the underside of the cover 38. The actuator arm 108 has a forwardly facing notch 110 that engages a post 80 on the shutter 58 so as to impart lateral movement to the actuator arm 108 from the movement of shutter 58.

Referring now specifically to FIG. 1, a front perspective view of refrigerator 10 is shown. Although refrigerator 10 is depicted as a so-called top mount refrigerator 10 having a freezer compartment 12 located above a refrigerated food compartment 14, the invention can be used to advantage with other types of refrigerators, Refrigerated food compartment 14 is defined by back wall 16, side walls 18, a floor 20, ceiling 22 and door 24. Operator temperature control 26 is located on backwall 16 and cold air is introduced into refrigerated food compartment 14 from the underside thereof. As is conventional, the air entering from operator temperature control 26 generally descends down to floor 20 because, having just passed across the evaporator (not shown), it is cooler than the air present in refrigerated food compartment 14. The cold air flows around shelves 28–31 if they are solid, or through them if they are wire shelves. Shelf 28 here supports a conventional meat keeper 32 and therefore generally would be a solid shelf. Here, shelves 28–31 are supported in cantilever fashion from brackets 34, although other suitable mounting structure could be used. Generally, the cold air having descended predominantly down the back wall 16 of refrigerated food comparment 14 flows forward and up along door 24 and is then drawn into partition 36 by a fan (not shown) for completing the recirculation loop back to the evaporator. Horizontally mounted shelf 38 is of solid construction as it provides a cover for sealing the top of side-by-side crisper pans 40.

Figure 2:
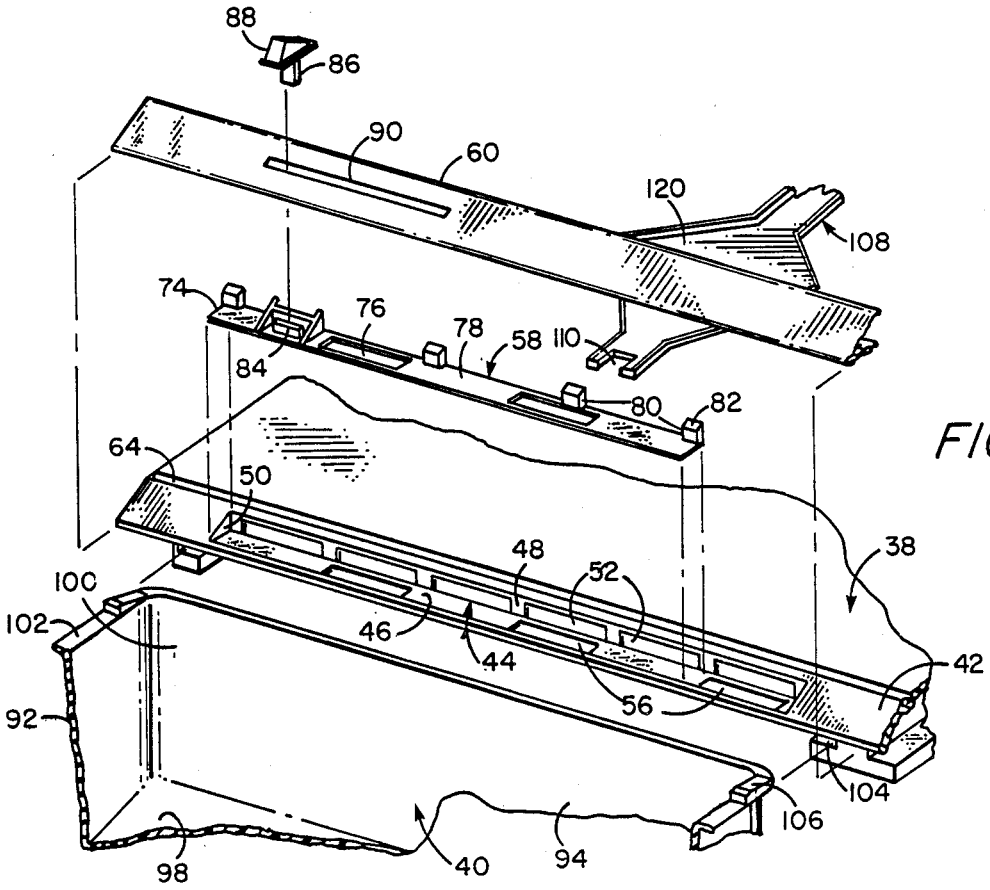
FIG. 2 is a partially broken-away exploded view of a crisper pan and a portion of the shelf under which it mounts.
Figure 9:
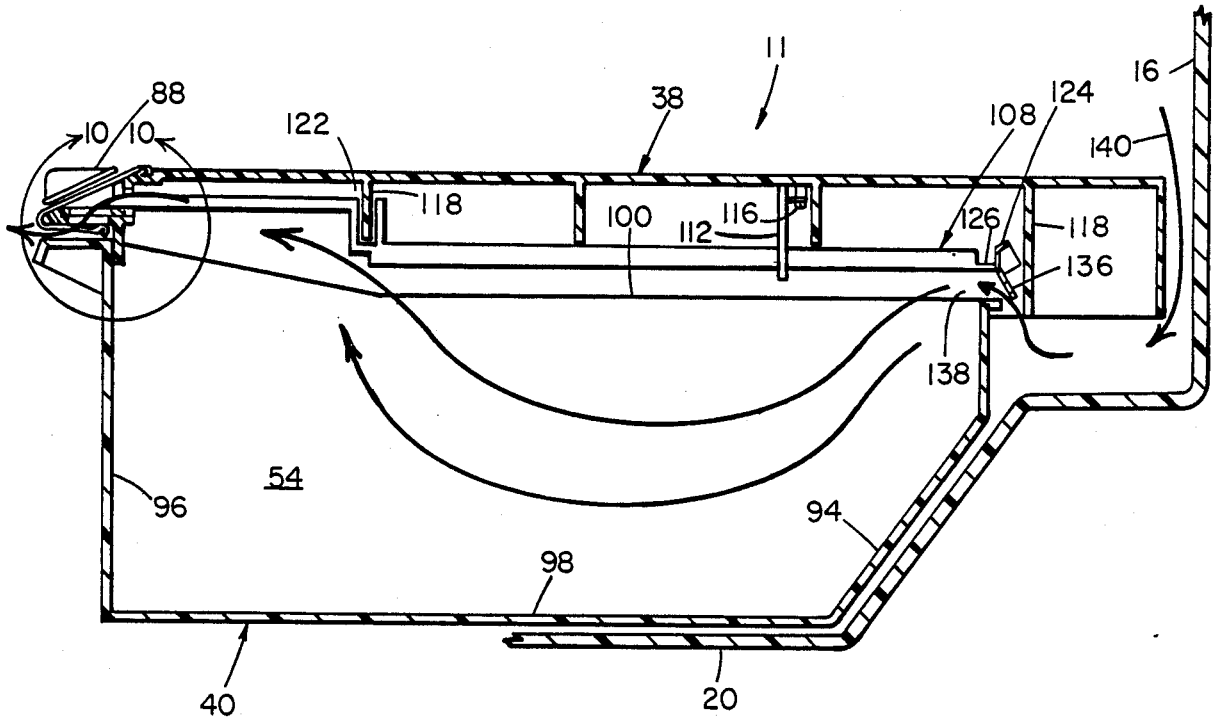
FIG. 9 is a side sectioned view of the container including the shelf and the crisper pan.
Figure 10:
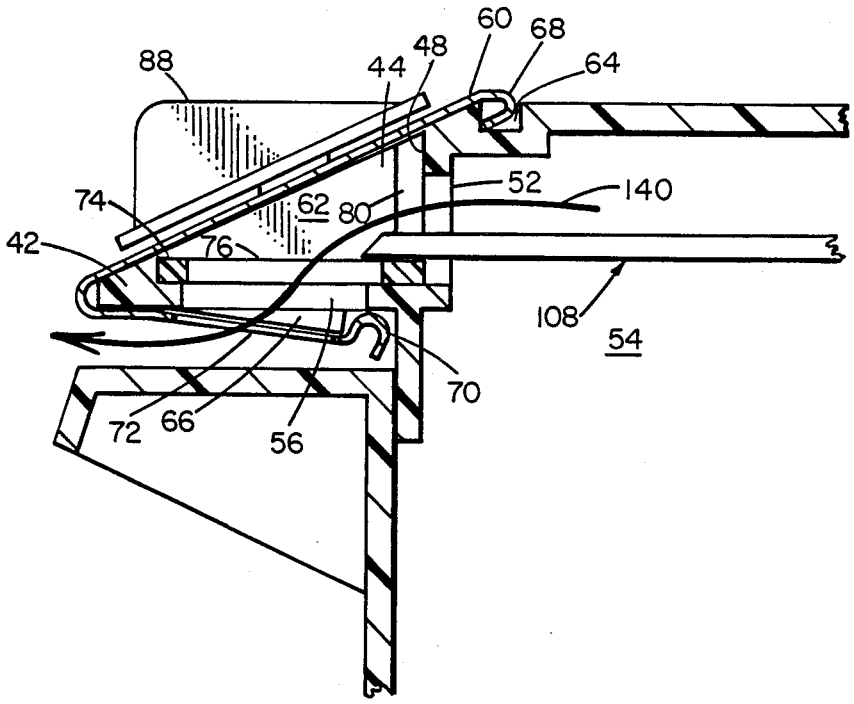
FIG. 10 is an expanded view of the front passageway.

Referring to FIG. 2, an exploded partially broken-away view of shelf 38 is shown. The front surface 42 of shelf 38 is inclined and has a central notch 44 or hollow defining a floor 46 or platform, a rear wall 48 and ends 50. Rear wall 48 has a plurality of apertures 52 that communicate with the interior chamber 54 (FIG. 9) of a crisper pan 40 when installed underneath shelf 38. Also, floor 46 has a plurality of spaced rectangular ports 56. Slide gate 58 or shutter which is preferably a plastic molded part seats on floor 46 and casing 60 clips over front surface 42 thereby enclosing notch 44 to define a cavity 62 (FIG. 10). Specifically, the top of shelf 38 may have a groove 64 (FIG. 10) and the underside edges may have ramps 66 which are adapted for receiving the respective edges 68 and 70 of casing 60. The underside of casing 60 is open or has a plurality of openings 72 which align with ports 56 so as not to impede the flow of air through ports 56.

Figure 3:
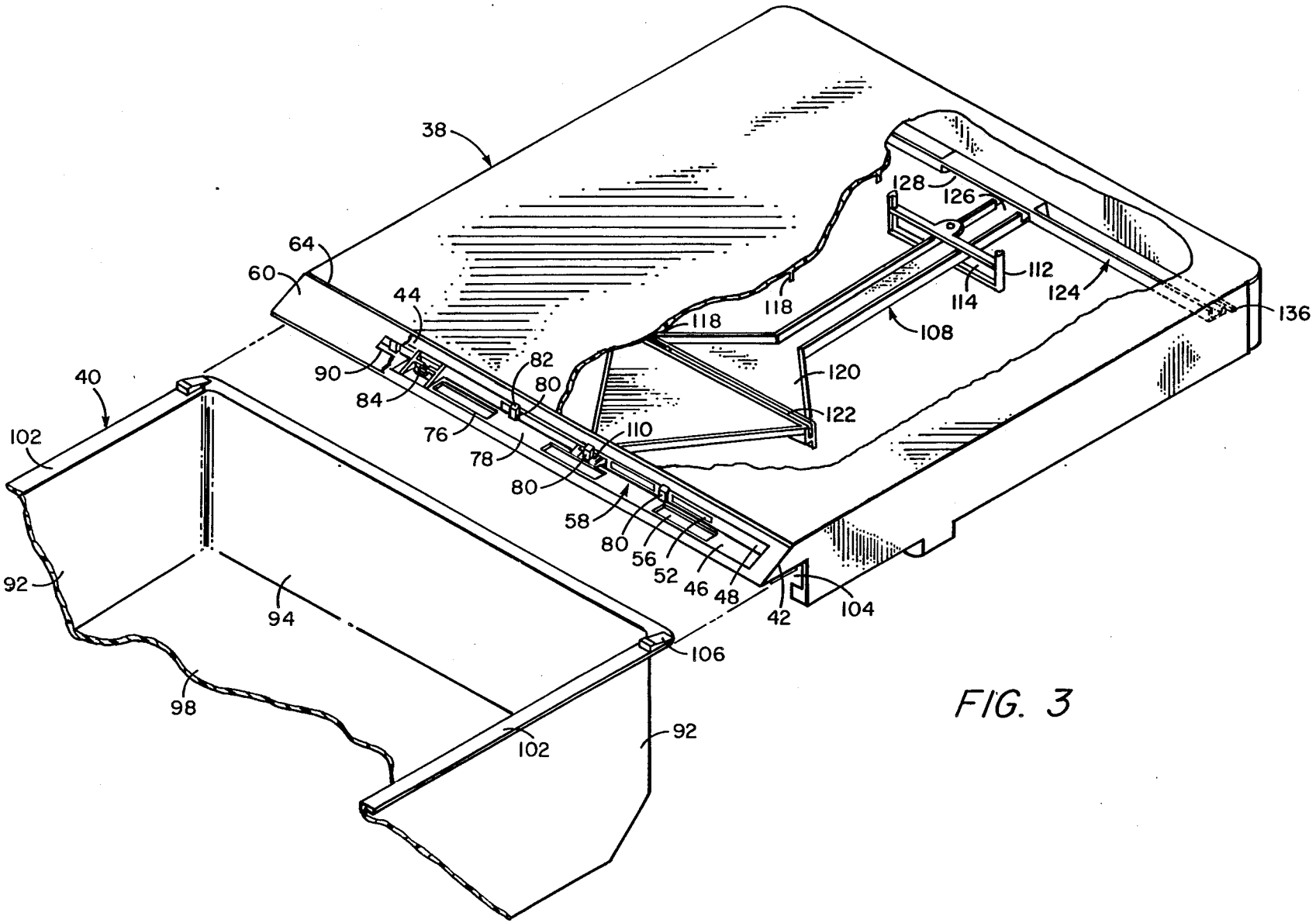
FIG. 3 is a broken-away view of the crisper pan shelf showing the damper actuator arm.

Slide gate 58 has a horizontal plate 74 with a plurality of windows 76 which are sized and spaced so as to overlay ports 56 in one lateral slide position of slide gate 58 on floor 46. Further, shutter regions 78 between windows 76 are shaped and spaced such that in another lateral slide position, they cover rectangular ports 56 thereby blocking the flow of air from the interior chamber 54 through apertures 52 and rectangular ports 56. Slide gate 58 also has a plurality of vertical posts 80 or columns with inclined tops 82 adapted for seating against the underside of casing 60 so as to prevent slide gate 58 from riding upwardly in cavity 62. Stated differently, posts 80 keep horizontal plate 74 firmly seated against floor 46 so as to prevent leakage around shutter regions 78 when slide gate 58 is in the closed position. Slide gate 58 also has a fastener 84 which connects to the neck 86 of slid knob 88. Neck 86 inserts through a laterally elongated slot 90 in casing 60 such that, slide knob 80 may be moved manually in the lateral direction so as to position slide gate 58 for opening and closing rectangular ports 56 with shutter regions 78. More specifically, when slide gate 58 is in the left-most position as shown in FIG. 3 such that windows 76 align with rectangular ports 56, a front passageway is provide such that air 140 is permitted to flow from interior chamber 54 through apertures 52 and out rectangular ports 56 as shown in FIG. 10. However, when slide gate 58 is slid to the right-most position within notch 44, shutter regions 78 cover rectangular ports 56 and the described air flow path is closed. At various positions of slide gate 58 between the left-most and right-most positions, shutter regions 78 close off varying amounts of rectangular ports 56.

Still referring to FIG. 2, crisper pan 40 or drawer which may conventionally be fabricated of metal or molded plastic is a generally rectangular box having side walls 92, a back wall 94, a front wall 96 (FIG. 9) and a bottom 98. The top 100 is open for access. Side walls 92 are bent or formed outwardly to provide flanged lips 102 from which crisper pan 40 is slidably supported. More specifically, as is conventional, shelf 38 has a pair of parallel slide channels 104 or guide grooves 4 running from front-to-back, and lips 102 are inserted thereinto. Crisper pan 40 can, of course, then be slid in and out from slide channels 104. Protruding bumps 106 are provided as stops so that crisper pans 40 cannot be completely removed unless properly inclined.

Still referring to FIG. 2, and more particularly to FIG. 3, damper actuator arm 108 has a front notch 110 that engages a vertical post 80 of slide gate 58. Damper actuator arm 108 extends longitudinally under shelf 38 and is supported at the front by horizontal plate 74 and at the rear by bracket 112 that has a window 114 providing lateral movement of damper actuator arm 108. As shown in FIG. 9, bracket 112 is affixed by suitable means such as screw 116 to the underside of shelf 38. Shelf 38 has a plurality of lateral ribs 118 on the underside that provide rigidity. Damper actuator arm 108 has a region 120 of lateral elongation with a lateral channel 122 in which one of the ribs 118 is received. Accordingly, as damper actuator arm 108 is moved in the lateral direction in response to lateral motion of slide gate 58, channel 122 tracks rib 118 thereby maintaining damper actuator arm 108 in a longitudinal orientation from front-to-back. Stated differently, channel 122 sliding on rib 118 prevents skewing and therefore keeps damper actuator arm 108 perpendicular to slide gate 58.

Figure 4:
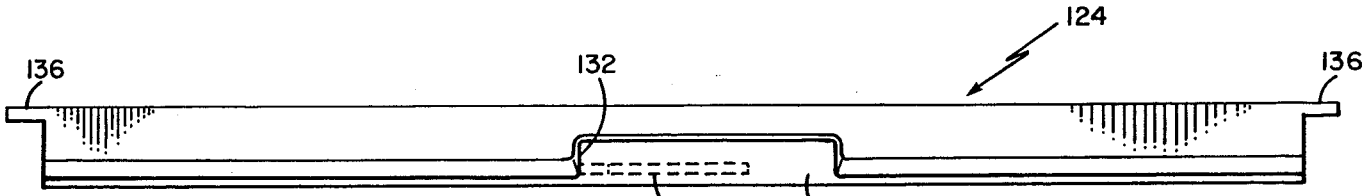
FIG. 4 is a top view of the damper flap.
Figure 5:
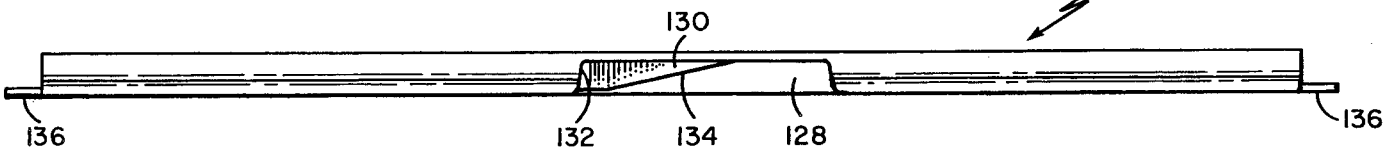
FIG. 5 is a front view of the damper flap.
Figure 6:
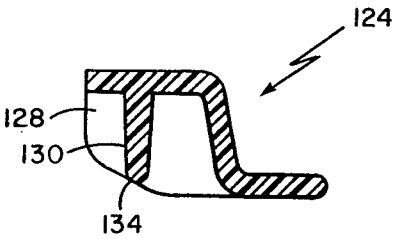
FIG. 6 is a side sectioned view of the damper flap.

Referring to FIG. 3 and also to FIGS. 4–6 that respectively show top, front, and side sectioned views of damper 124 or damper flap, damper actuator arm 108 has a projecting blade 126 or finger that inserts into a central recess 128 of damper 124. Recess 128 has a lateral ramp 130 projecting from one side 132 thereby providing an inclined surface 134. Molded pivot pins 136 extend from the ends of damper 124 and are rotatably mounted on the undersides of shelf 38. When projecting blade 126 is to the right side of recess 128 as shown in FIG. 5, damper 124 is in the down position as shown in FIG. 8. However, when the operator moves control knob 88 to the left resulting in post 80 forcing damper actuator arm 108 to the left, blade 126 moves to the left in recess 128. As it does so, inclined surface 134 rides up on blade 126 thereby rotating damper 124 about the axis of pivot pins 136 to an up or open position. In other words, in the left-most position of damper actuator arm 108, damper 124 is rotated about pivot pins 136 to the completely open position shown in FIG. 7, and a back passageway is provided for air to flow up through the space 138 between back wall 94 and rib 118 as shown. At various graduated positions of damper actuator arm 108 between left-most and right-most, damper 124 is opened in varying amounts.

Figure 7:
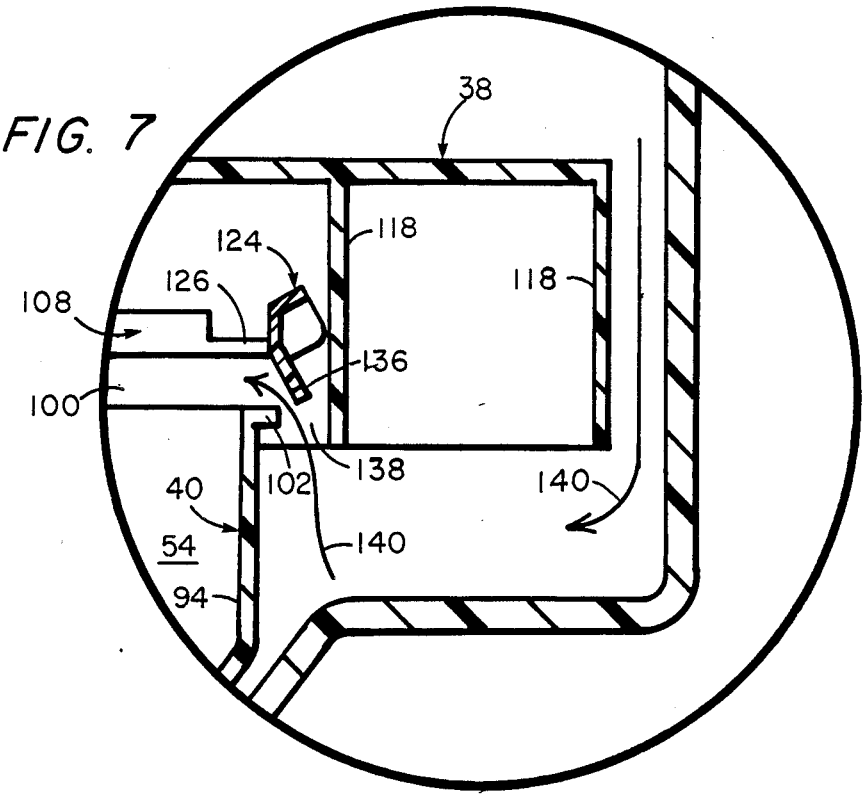
FIG. 7 is a side sectioned view of the back passageway between the crisper pan and the shelf with the damper flap open.
Figure 8:
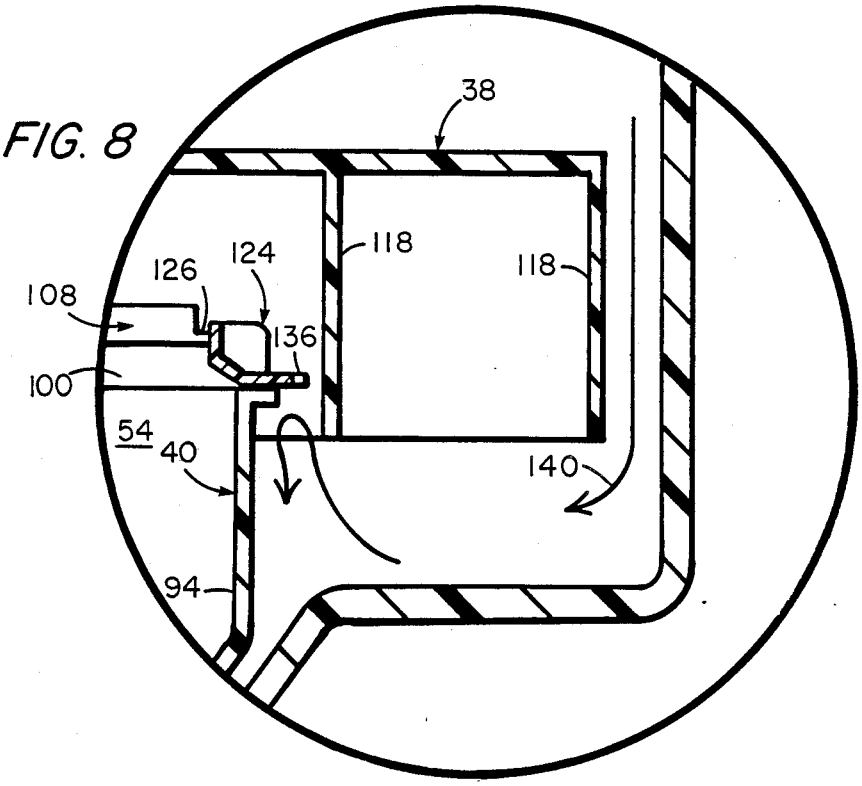
FIG. 8 is a side sectioned view of the back passageway between the crisper pan and the shelf with the damper flap closed.

In operation, the operator uses slide knob 88 to push slide gate 58 to the open position as shown in FIGS. 3 and 7 when relatively low humidity is desired in interior chamber 54. In this operative configuration as shown in a side sectioned view in FIG. 9, the front and back passageways are completely open and a portion of the cold air 140 migrating down the back wall of refrigerated food compartment 14 is enabled to flow through space 138 into interior chamber 54 and out the front passageway thereby providing flow-through ventilation. The air flows the entire length of crisper pan 40 from back-to-front and therefore relatively uniform humidity is provided within interior chamber 54 of crisper pan 40. With reference to FIG. 10, an expanded view of the front passageway is shown. Windows 76 are aligned with ports 56 such that air is free to pass through apertures 52 into cavity 64 from where it is exhausted by the force of natural convection through windows 76 and ports 56.

When relatively high humidity is desired in crisper pan 40, the operator uses control knob 88 to push slide gate 58 to the closed position which, with reference to FIG. 3, is to the right. In the closed position, shutter regions 78 are located over ports 56 thereby closing off the front passageway through shelf 38. Also, the motion of posts 80 of slide gate 58 forces damper actuator arm 108 to the right thereby moving blade or finger 126 to the right and allowing inclined surface 134 of ramp 130 to ride down by gravity to close the back passageway as shown in FIG. 8. Accordingly, in response to control knob 88, slide gate 58 and damper flap 124 are operated cooperatively or in unison to close or open the front and back passageways. When both are closed, the interior chamber 54 of crisper pan 40 is sealed at the front and back, and also along the sides where the flanged lips 102 engage slide channels such that very little moisture can escape from crisper pan 40.

This completes the Description of the Preferred Embodiment. A reading of it by those skilled in the art will bring to mind many alterations and modifications without departing from the spirit and scope of the invention. Accordingly, it is intended that the scope of the invention be limited only by the appended claims.

What is claimed is:

1. A container for providing a relatively high humidity storage region in refrigerator compartment, comprising:

a drawer having a bottom, side walls, a back wall, and a front wall, the top of each of said side walls having a flanged lip;

a cover adapted for stationary horizontal mounting in said refrigerator compartment, said cover having underside parallel slide channels for receiving said lips of said drawer wherein said drawer is slidably engagable in said slide channels to a closed position underneath said cover, said back wall of said drawer being spaced from said cover in said closed position thereby providing a back passageway into said drawer;

a damper flap laterally positioned and pivotally mounted to the underside of said cover for opening and closing said back passageway;

said cover having a front port and a manually actuable laterally slidably shutter for opening and closing said front port; and a damper actuator arm linked between said shutter and said damper flap, said actuator arm rotating said damper flap in response to manual activation of said front shutter to open and close said back passageway in unison with the opening and closing of said front port.

2. The container recited in claim 1 wherein said damper activator arm comprises a rearwardly extending finger and said damper flap comprises a ramp that rides up on said finger.

3. The container recited in claim 2 wherein said damper actuator arm comprises means for maintaining said damper actuator arm in a front-to-back orientation.

4. The container recited in claim 3 wherein said cover has a lateral underside rib and said maintaining means comprises an upwardly facing channel engaging said rib.

5. The container recited in claim 4 wherein said shutter comprises a vertical post and said damper actuator arm has a forwardly facing notch engaging said post.

6. A refrigerator comprising:

a refrigerated food compartment comprising side walls, a back wall, a floor, a ceiling, and a front door;

means for introducing cold air into said food compartment adjaent to said ceiling through said back wall, said cold air flowing down along said back wall and up along said front door by natural convection;

a relatively high humidity chamber positioned adjacent to said floor for storing food within said refrigerated food compartment, said chamber comprising a horizontal shelf having parallel underside front-to-back guide channels;

said chamber further comprising a pan having parallel rims with flanges for slidably engaging said guide channels, said pan being slidable in said channels between a back closed position underneath said shelf wherein said shelf provides a cover for said pan and a front open position used for accessing the interior of said pan from its top side;

said pan having a rear wall spaced from said shelf thereby providing a back passageway into said pan and said shelf having a front port thereby providing a front passageway from said pan wherein said cold air introduced into said refrigerated food compartment provides flow-through ventilation of said pan by flowing under natural convection down said back wall into said pan through said back passageway and out said front passageway up said refrigerator door;

a laterally slidable manually actuable front control knob; and means responsive to said control knob for adjusting the size of said front and back passageways, said adjusting means comprising a laterally slidable front shutter connected to said knob and a damper flap pivotally mounted to said shelf for opening and closing said back passageway, said adjusting means further comprising a damper actuation arm coupled from said damper flap to said front shutter.

7. The refrigerator recited in claim 6 wherein said damper actuator arm comprises a front facing notch engaging said shutter.

8. The refrigerator recited in claim 7 further comprising means for maintaining said damper actuator arm in a longitudinal front-to-back orientation.

9. The refrigerator recited in claim 8 wherein said shelf has a lateral underside rib and said maintaining means comprises a lateral upward-facing channel engaging said rib.

10. The refrigerator recited in claim 9 wherein said damper flap comprises a ramp adapted for riding up on said damper actuator arm and rotating said damper flap in response thereto.

11. The refrigerator recited in claim 10 wherein said damper flap comprises a pair of pins extending longitudinally therefrom and engaging the underside of said horizontal shelf, said damper flap being rotatable about the axis of said pins.

* * * * *